United States Patent [19]

Lee

[11] Patent Number: 4,958,738

[45] Date of Patent: Sep. 25, 1990

[54] CLOTHING RACK AND HANGER COMPOSITE STRUCTURE

[76] Inventor: Daniel S. Lee, 1537 Melton Rd., Lutherville, Md. 21093

[21] Appl. No.: 426,725

[22] Filed: Oct. 26, 1989

[51] Int. Cl.[5] ..... A47F 5/00

[52] U.S. Cl. ..... 211/89; 211/124; 223/96

[58] Field of Search ..... 211/94.5, 89, 105.1, 211/124; 248/100, 101; 223/95, 96

[56] References Cited

U.S. PATENT DOCUMENTS

| | | | |
|---|---|---|---|
| 724,427 | 4/1903 | Bonsall | 211/89 |
| 790,112 | 5/1905 | Cummings | 211/89 |
| 1,457,644 | 6/1923 | White et al. | 211/89 X |
| 1,900,796 | 3/1933 | Carter | 211/89 |
| 2,466,195 | 4/1949 | Anderson et al. | 211/89 |
| 2,576,089 | 11/1951 | Ehmke | 223/95 |
| 2,682,980 | 7/1954 | Ambrosino | 223/95 |
| 3,559,852 | 2/1971 | Green | 223/96 |
| 4,316,547 | 2/1982 | Varon | 211/124 X |

OTHER PUBLICATIONS

Dann Dee, Display Fixtures, pp. 57–61, 1988–1989.

*Primary Examiner*—David L. Talbott

*Attorney, Agent, or Firm*—Birch, Stewart, Kolasch & Birch

[57] ABSTRACT

A combined clothing rack and hanger device which includes a main rack having a plurality of hook hangers disposed on one side and a plurality of squeezing hangers disposed on the other side thereof, and a channel engagement mounted to one end of the main rack, whereby the plurality of hanger devices are disposed in parallel by engaging the main rack on a rail support through the channel engagement.

6 Claims, 1 Drawing Sheet

CLOTHING RACK AND HANGER COMPOSITE STRUCTURE

BACKGROUND OF THE INVENTION

1. Field of the Invention

The present invention relates to a clothing rack and hanger composite structure and more particularly, to a combined clothing rack and hanger device which includes a main rack having a plurality of hook hangers disposed on one side and a plurality of squeezing hangers disposed on the other side thereof, and a channel engagement mounted to one end of the main rack, whereby the plurality of hanger devices are disposed in parallel by engaging the main rack on a rail support through the channel engagement for arranging the plurality of hook hangers and squeezing hangers alternately so as to easily hang clothes such as pants, skirts, and the like by using both the hook and squeezing hangers.

2. Description of the Prior Art

Various types of clothing racks and separate hangers are well known. Also, various types of clothing racks are known having a plurality of hook hangers such as square tubing faceouts, rectangular tubing faceouts, and the like as described in Dann Dee, Display Fixture, pages 57–61, 1988-1989. However, such separate racks require separate hangers, and such faceouts require separate hangers. The separate hangers may be lost and are cumbersome to handle at times. There is unknown a clothing rack and hanger composite structure.

SUMMARY OF THE INVENTION

Accordingly, it is an object of the present invention to provide a clothing rack and hanger composite structure.

Another object of the present invention is to provide a combined clothing rack and hanger device which includes a main rack having a plurality of hook hangers disposed on one side and a plurality of squeezing hangers disposed on the other side thereof, and a channel engagement mounted to one end of the main rack, whereby the plurality of hanger devices are disposed in parallel by engaging the main rack on a rail support through the channel engagement for arranging the plurality of hook hangers and squeezing hangers alternately so as to easily hang clothes such as pants, skirts, and the like by using both the hook and squeezing hangers.

A further object of the present invention is to provide a clothing rack and hanger composite structure device which is simple in construction, compact for portability, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a combined clothing rack and hanger device which includes a main rack having a plurality of hook hangers disposed on one side and a plurality of squeezing hangers disposed on the other side thereof, and a channel engagement mounted to one end of the main rack, whereby the plurality of hanger devices are disposed in parallel by engaging the main rack on a rail support through the channel engagement.

BRIEF DESCRIPTION OF THE DRAWINGS

The present invention will become more fully understood form the detailed description given hereinbelow and the accompanying drawings which are given by way of illustration only, and thus are not limitative of the present invention, and wherein.

DESCRIPTION OF THE PREFERRED EMBODIMENTS

Figure 1:
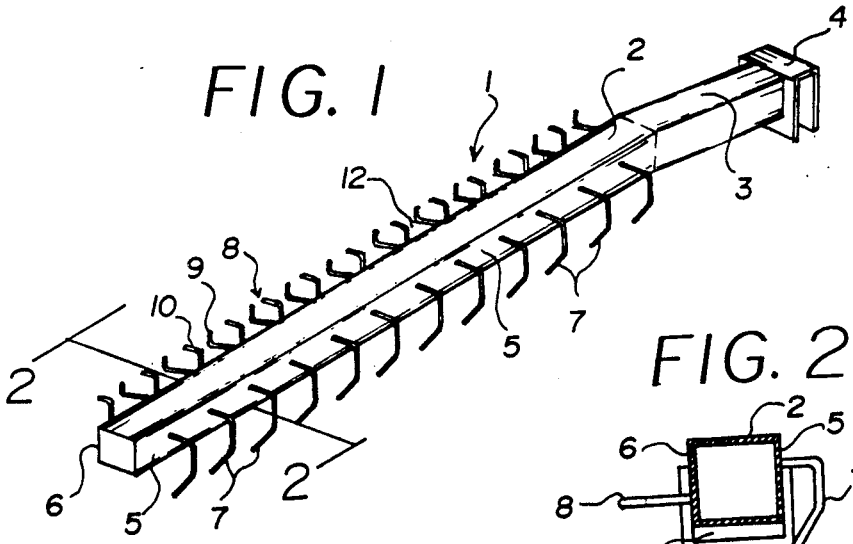
FIG. 1 is a perspective view of a rack and hanger composite structure according to the present invention.

Referring now in detail to the drawings for the purpose of illustrating preferred embodiments of the present invention, the clothing rack and hanger composite structure 1 as shown in FIG. 1 comprises a main rack 2, an extension rack 3 extending from the main rack 2, a channel engagement mounted to the end of the extension rack 3, and a plurality of hook hangers 7 and squeezing hangers 8 mounted on both sides 5 and 6 of the main rack 2, respectively.

Figure 2:
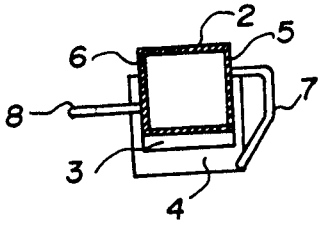
FIG. 2 is a cross-sectional view of FIG. 1, taken along lines 2—2.
Figure 3:
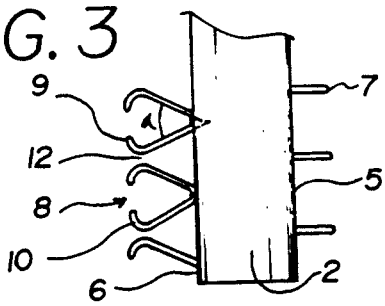
FIG. 3 is a top plan view of FIG. 1 showing a plurality of hook and squeezing hangers.
Figure 4:
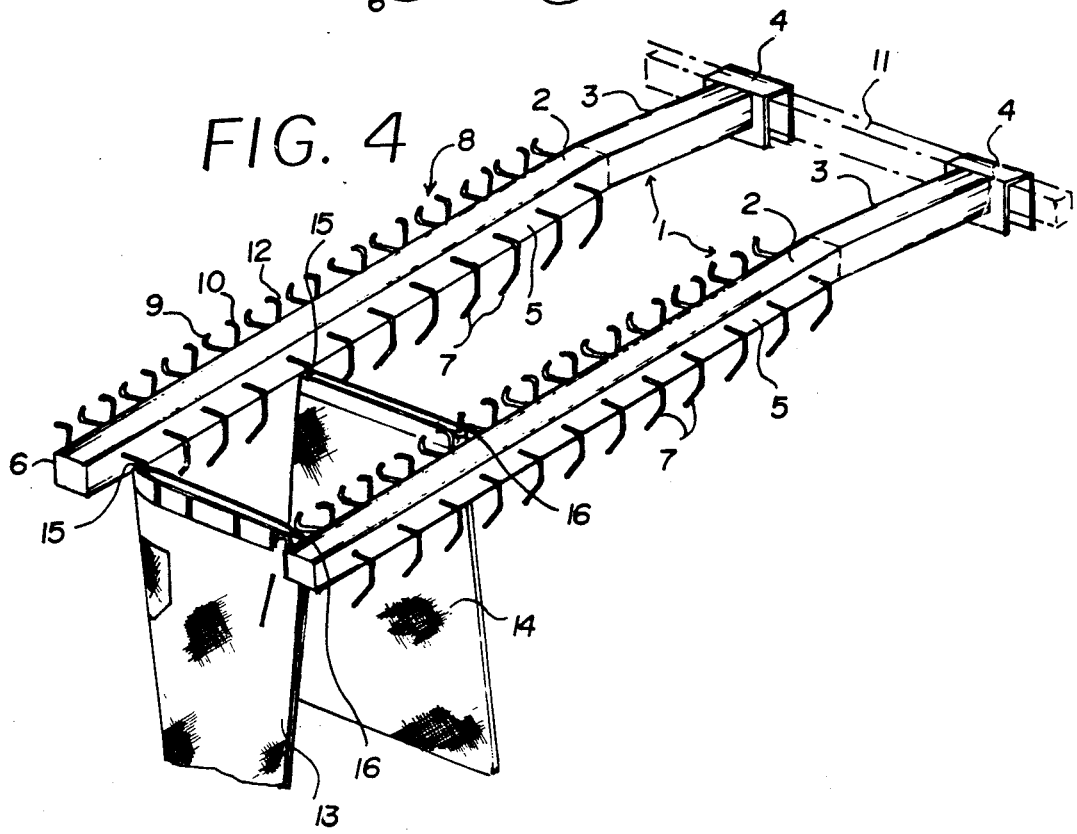
FIG. 4 is a perspective view of a pair of and clothing rack and hanger composite structure both disposed in parallel according to the present invention illustrating how a pair of pants and a skirt are hung by the hangers of the composite structure.

As shown in FIGS. 2 and 3, each hook hanger 7 has a C-shaped configuration and is mounted on the upper portion of one side 5 of the main rack 2 at one end thereof and the other end thereof faces downward so as to easily allow for insertion of a bent back portion 15 into a portion of the clothes such as a pair of pants 13 and/or a skirt 14 thereon and to allow for easy remoVal of the clothes 13 and 14 therefrom (FIG. 1 . The hook hanger 7 may be made of nonflexible, solid materials such as plastic or steel, and its thickness may be about 3/16 to 5/32 inches. Each squeezing hanger 8 is composed of a pair of V-shaped hangers 9 and 10 which face each other at an angle $\alpha$ of about 45°–90°, preferably about 60°. The V-shaped hangers 9 and have bent ends, respectively. Therefore, one squeezing hanger 8 forms a squeezing space or gap 12 with the other squeezing hangers 8 so as to allow for insertion of a bent front portion 16 of clothes such as pants 13 and/or skirts 14 into the squeezing space 12 (FIG. 4). The squeezing hanger 8 may be made of flexible materials such as plastic, steel, stainless steel, and the like and has a thickness of about $\frac{1}{8}$ to 3/32 inches. Thus, the plurality of hook hangers 7 are mounted on one side 5 of the main rack 2 so as to be aligned with the plurality of squeezing spaces 12 of the squeezing hangers 8 mounted on the other side 6 of the main rack 2 for hanging the clothes 13 and 14 in a straight manner on the hangers 7 and 8 (FIG. 4).

The extension rack 3 may extend with a slight bent portion for providing a slight slope to the main rack 2 while the clothing rack and hanger composite structure 1 engages with a rail support 11 (FIGS. 2 and 4). The main rack 2 and the extension rack 3 have a rectangular configuration or a rod configuration.

As shown in FIG. 4, the plurality of clothing and hanger composite structure devices 1 may be supported by the rail support 11 by slidably engaging the channel engagements 4 thereof on the rail support 11 in parallel. Also, the gap of both composite structure devices 1 can be controlled depending upon the width of clothes 13 and 14. It is easy to manufacture the composite structure devices 1 according to the present invention since the hook and squeezing hangers 7 and 8 can be attached to the main rack 2 by a molding or securing method known in the art so that it is inexpensive. Also, the composite structure device 1 is compact for portability, durable in use, and refined in appearance.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A clothing rack and hanger composite structure comprising:

at least two main racks with each having an extension rack extending therefrom, said extension rack extending from the main rack at an angle so as to provide a slight bending form for giving a slight slope to said rack and hanger composite structure, a plurality of hook hangers mounted on one side of said main rack, said hook hangers having a C-shaped configuration, respectively, a plurality of squeezing hangers mounted on the other side of said main rack, said squeezing hangers defining a plurality of V-shaped configurations adjacent to each other for forming a plurality of squeezing spaces between said squeezing hangers, said hook hangers being disposed so as to be aligned with said squeezing spaces formed between said squeezing hangers for hanging clothes between the hook hangers of one main rack and the squeezing spaces of the other main rack in a straight manner, a channel engagement attached to one end of said extension rack for engaging the rack and hanger composite structure with a rail support, whereby clothes such as pants, skirts, and the like can be tightly attached to and easily removed from the rack and hanger composite structure.

2. The clothing rack and hanger composite structure of claim 1, wherein the hook hanger faces downward at one end thereof for easily attaching clothes thereto and removing them from the hook hanger.

3. The clothing rack and hanger composite structure of claim 1, wherein the squeezing hanger is provided with an angle of about 45° to 90°.

4. The clothing rack and hanger composite structure of claim 1, wherein the angle is about 60°.

5. The clothing rack and hanger composite structure of claim 1, wherein the hook hanger is formed from non-flexible materials and the squeezing hanger is formed from flexible materials.

6. The clothing rack and hanger composite structure of claim 1, wherein the non-flexible and flexible materials are selected from the group consisting of plastic, steel, and stainless steel.

* * * * *